US012560085B2

(12) United States Patent
Bloom et al.

(10) Patent No.: US 12,560,085 B2
(45) Date of Patent: Feb. 24, 2026

(54) ROTATABLE CUTTING TOOL WITH CUTTING INSERT AND BOLSTER

(71) Applicant: Kennametal Inc., Latrobe, PA (US)

(72) Inventors: Robbie D. Bloom, Hooversville, PA (US); James R. Geyer, Manns Choice, PA (US); Brandon J. Kenno, Windber, PA (US)

(73) Assignee: KENNAMETAL INC., Latrobe, PA (US)

( * ) Notice: Subject to any disclaimer, the term of this patent is extended or adjusted under 35 U.S.C. 154(b) by 250 days.

(21) Appl. No.: 18/231,845

(22) Filed: Aug. 9, 2023

(65) Prior Publication Data

US 2025/0052154 A1 Feb. 13, 2025

(51) Int. Cl.
*E21C 35/183* (2006.01)

(52) U.S. Cl.
CPC ..... *E21C 35/1837* (2020.05); *E21C 35/1835* (2020.05)

(58) Field of Classification Search
CPC ..... E21C 35/1837; E21C 35/1835
See application file for complete search history.

(56) References Cited

U.S. PATENT DOCUMENTS 3,342,532 A * 9/1967 Krekeler ..... E21C 35/19 175/413
3,397,012 A 8/1968 Krekeler
4,397,362 A 8/1983 Dice et al.
4,850,649 A 7/1989 Beach et al.
4,886,710 A 12/1989 Greenfield
4,944,559 A 7/1990 Sionnet et al.
5,131,725 A 7/1992 Rowlett et al.
5,141,289 A 8/1992 Stiffler
5,161,627 A 11/1992 Burkett
(Continued)

FOREIGN PATENT DOCUMENTS

AU 2017202325 B2 12/2017
CN 104775814 A 7/2015
(Continued)

OTHER PUBLICATIONS

Oct. 23, 2023 Foreign Office Action Chinese Application No. CN201710337831.1, 20 Pages.
(Continued)

*Primary Examiner* — Janine M Kreck
(74) *Attorney, Agent, or Firm* — Christopher J. Owens

(57) ABSTRACT

A rotatable cutting tool includes a cutting tool body with a head portion. A bolster is at least partially received in the head portion and includes a socket, a collar portion and a shank portion. The socket is formed with a conical side wall and a radius blend. A hard tip or cutting insert is at least partially received in the socket and includes a conical head portion, a collar portion and an axially rearward frustoconical portion that generally conforms to the geometry of the socket of the bolster. The shank portion of the bolster provides a narrow bottom style geometry and the axially rearward frustoconical portion of the cutting insert provides a tapered geometry that together increases the strength of a braze joint between the bolster and the base portion, thereby reducing forces and stresses transmitted to the cutting tool during a machining operation.

20 Claims, 6 Drawing Sheets

(56) References Cited

U.S. PATENT DOCUMENTS

| | | | | |
|---|---|---|---|---|
| 5,324,098 | A | 6/1994 | Massa et al. | |
| 5,421,423 | A | 6/1995 | Huffstutler | |
| D387,072 | S | 12/1997 | Ojanen | |
| 5,702,160 | A | 12/1997 | Levankovskii et al. | |
| 5,873,423 | A * | 2/1999 | Briese | E21C 35/183 175/430 |
| 6,375,272 | B1 | 4/2002 | Ojanen | |
| 6,644,755 | B1 | 11/2003 | Kammerer | |
| D490,286 | S | 5/2004 | Simons | |
| 7,396,086 | B1 | 7/2008 | Hall et al. | |
| 7,419,224 | B2 | 9/2008 | Hall et al. | |
| D627,804 | S | 11/2010 | Fader et al. | |
| D627,808 | S | 11/2010 | Kammerer | |
| D627,809 | S | 11/2010 | Kammerer | |
| D636,797 | S | 4/2011 | Kammerer | |
| D637,213 | S | 5/2011 | Kammerer | |
| 8,028,774 | B2 | 10/2011 | Hall et al. | |
| 8,250,786 | B2 | 8/2012 | Hall et al. | |
| D692,039 | S | 10/2013 | Buhr et al. | |
| D707,269 | S | 6/2014 | Meier | |
| D707,270 | S | 6/2014 | Meier | |
| 8,931,854 | B2 | 1/2015 | Hall | |
| D839,936 | S | 2/2019 | Weber et al. | |
| 10,294,786 | B2 * | 5/2019 | Weber | E21C 35/19 |
| 10,465,512 | B2 | 11/2019 | Kenno et al. | |
| 11,585,217 | B2 | 2/2023 | Kenno et al. | |
| 2003/0209366 | A1 | 11/2003 | McAlvain | |
| 2004/0026132 | A1 | 2/2004 | Hall et al. | |
| 2004/0065484 | A1 | 4/2004 | McAlvain | |
| 2007/0040442 | A1 | 2/2007 | Weaver | |
| 2008/0315667 | A1 | 12/2008 | Hall et al. | |
| 2009/0066149 | A1 | 3/2009 | Hall et al. | |
| 2009/0256413 | A1 * | 10/2009 | Majagi | B28D 1/188 299/111 |
| 2009/0273225 | A1 | 11/2009 | Hall et al. | |
| 2010/0194177 | A1 | 8/2010 | Woehrstein et al. | |
| 2010/0206641 | A1 | 8/2010 | Hall et al. | |
| 2010/0263939 | A1 | 10/2010 | Hall et al. | |
| 2010/0295360 | A1 | 11/2010 | Krämer et al. | |
| 2011/0080037 | A1 | 4/2011 | Swope et al. | |
| 2011/0175430 | A1 | 7/2011 | Heiderich et al. | |
| 2012/0049608 | A1 | 3/2012 | Ritchey et al. | |
| 2012/0068528 | A1 | 3/2012 | Grief et al. | |
| 2012/0146390 | A1 | 6/2012 | Flynn et al. | |
| 2012/0242136 | A1 | 9/2012 | Ojanen et al. | |
| 2013/0207445 | A1 | 8/2013 | Bell | |
| 2014/0054951 | A1 | 2/2014 | Bookhamer et al. | |
| 2014/0262541 | A1 | 9/2014 | Hongyao et al. | |
| 2015/0198040 | A1 | 7/2015 | Weaver et al. | |
| 2016/0024918 | A1 | 1/2016 | Brown et al. | |
| 2017/0043452 | A1 | 2/2017 | Daniels et al. | |
| 2017/0234128 | A1 | 8/2017 | Bush et al. | |
| 2017/0342831 | A1 | 11/2017 | Paros et al. | |
| 2018/0003051 | A1 | 1/2018 | Kramer et al. | |
| 2018/0245467 | A1 * | 8/2018 | Kenno | E21C 35/1837 |
| 2019/0323346 | A1 | 10/2019 | Sollammi | |
| 2022/0290562 | A1 | 9/2022 | Geyer et al. | |
| 2022/0341321 | A1 | 10/2022 | Bloom et al. | |

FOREIGN PATENT DOCUMENTS

| | | | |
|---|---|---|---|
| CN | 304064522 | S | 3/2017 |
| DE | 102013105348 | A1 | 12/2013 |
| DE | 102017110537 | A1 | 11/2017 |
| DE | 112018001043 | T5 | 12/2019 |

OTHER PUBLICATIONS

Apr. 30, 2024 Foreign Office Action Canadian Application No. CA20183049987, 3 Pages.

International Preliminary Report on Patentability for International Application No. PCT/US2018/019962, mailed Sep. 12, 2019, 14 Pages.

International Search Report and Written Opinion for International Application No. PCT/US2018/019962, mailed May 24, 2018, 20 Pages.

Jun. 15, 2017 Non-Final Office Action U.S. Appl. No. 29/565,804,12 Pages.

Oct. 16, 2017 Final Office Action U.S. Appl. No. 29/565,804 5 Pages.

Nov. 9, 2022 Foreign Office Action German Application No. 112018001043.0, 12 Pages.

Apr. 20, 2023 Foreign Office Action Chinese Application No. CN201710337831.1, 17 Pages.

Jul. 25, 2023 Foreign Office Action Chinese Application No. CN201710337831.1, 16 Pages.

http://srpicks.com/productlists.asp?SortID=103&parentid=103.

www.kennametal.com/en/products/17442915/100028050.html.

www.kennametal.com/hi/products/18934469/surface-mining/cutting-tools.html.

* cited by examiner

ROTATABLE CUTTING TOOL WITH CUTTING INSERT AND BOLSTER

FIELD OF THE INVENTION

The invention pertains to a rotatable cutting tool that is useful for the impingement of earth strata such as, for example, asphaltic roadway material, coal deposits, mineral formations and the like. More specifically, the invention pertains to a rotatable cutting tool with a cutting tip and bolster that is useful for the impingement of earth strata that reduces stresses and forces transmitted to the cutting tool during a machining operation, thereby improving performance characteristics for the rotatable cutting tool.

BACKGROUND OF THE INVENTION

Rotatable cutting tools have been used to impinge earth strata, such as, for example, asphaltic roadway material or ore bearing or coal bearing earth formations, or the like. Generally speaking, these kinds of rotatable cutting tools have an elongate cutting tool body typically made from steel and a hard tip (or cutting insert) affixed to the cutting tool body at the axial forward end thereof. The hard tip is typically made from a hard material such as, for example, cemented (cobalt) tungsten carbide. The rotatable cutting tool is rotatably retained or held in the bore of a tool holder or, in the alternative, in the bore of a sleeve that is in turn held in the bore of a holder.

The holder is affixed to a driven member such as, for example, a driven drum of a road planning machine. In some designs, the driven member (e.g., drum) carries hundreds of holders, wherein each holder carries a rotatable cutting tool. Hence, the driven member may carry hundreds of rotatable cutting tools. The driven member is driven (e.g., rotated) in such a fashion so that the hard tip of each one of the rotatable cutting tools impinges or impacts the earth strata (e.g., asphaltic roadway material), thereby fracturing and breaking up the material into debris.

As can be appreciated, during operation the rotatable cutting tool and the cutting insert are typically subjected to a variety of extreme cutting forces and stresses in an abrasive and erosive environment. The overall total length of the cutting insert, and in particular, the length that the cutting insert extends from the axial forward end of the cutting tool, determines the amount of forces and stresses that are transmitted to the cutting tool during operation. In other words, the more the cutting insert extends from the cutting tool, the larger the forces and stresses that will be generated, which may result in tool failure.

SUMMARY OF THE INVENTION

The invention solves the problem of the transmission of excessive forces and stresses to the cutting tool by providing a cutting insert that is at least partially received in a socket of a bolster, wherein the shank portion of the bolster provides a narrow bottom style geometry and the cutting insert provides a tapered geometry that together increases the strength of a braze joint between the bolster and the base portion, thereby reducing forces and stresses transmitted to the cutting tool during a machining operation.

In one aspect of the invention, a rotatable cutting tool comprises a cutting tool body, a bolster and a cutting insert. The cutting tool body has an axial forward end, an axial rearward end, a head portion axially rearward of the axial forward end, a collar portion axially rearward of the head portion, and a shank portion axially rearward of the collar portion and axially forward of the axial rearward end. The head portion includes a base portion formed with a pocket. The bolster is at least partially received in the pocket. The bolster includes a head portion, a collar portion and a shank portion. The head portion includes a socket formed with a side wall and a radius blend formed with a radius, R2. The shank portion includes a rearwardly tapering frustoconical section, a variably tapered section extending in a rearward direction from the rearwardly tapering frustoconical section, and a cylindrical section extending in the rearward direction from the variably tapered section. The cutting insert is at least partially received in the socket of the bolster. The cutting insert comprises a super hard material bonded to a cemented metal carbide substrate and includes a conical head portion, a collar portion and an axially rearward frustoconical portion. The shank portion of the bolster provides a narrow bottom style geometry and the axially rearward frustoconical portion of the cutting insert provides a tapered geometry that together increases the strength of a braze joint between the bolster and a base portion of the cutting tool body, thereby reducing forces and stresses transmitted to the cutting tool during a machining operation.

In another aspect of the invention, a cutting insert comprises a conical head portion having a length, L1, a collar portion having a length, L2, and an axially rearward frustoconical portion having a length, L3, wherein the length, L3, of the axially rearward frustoconical portion is between about forty percent (40%) and about fifty-five percent (55%) of a total length, L4, of the cutting insert.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

DETAILED DESCRIPTION OF THE INVENTION

Figure 1:
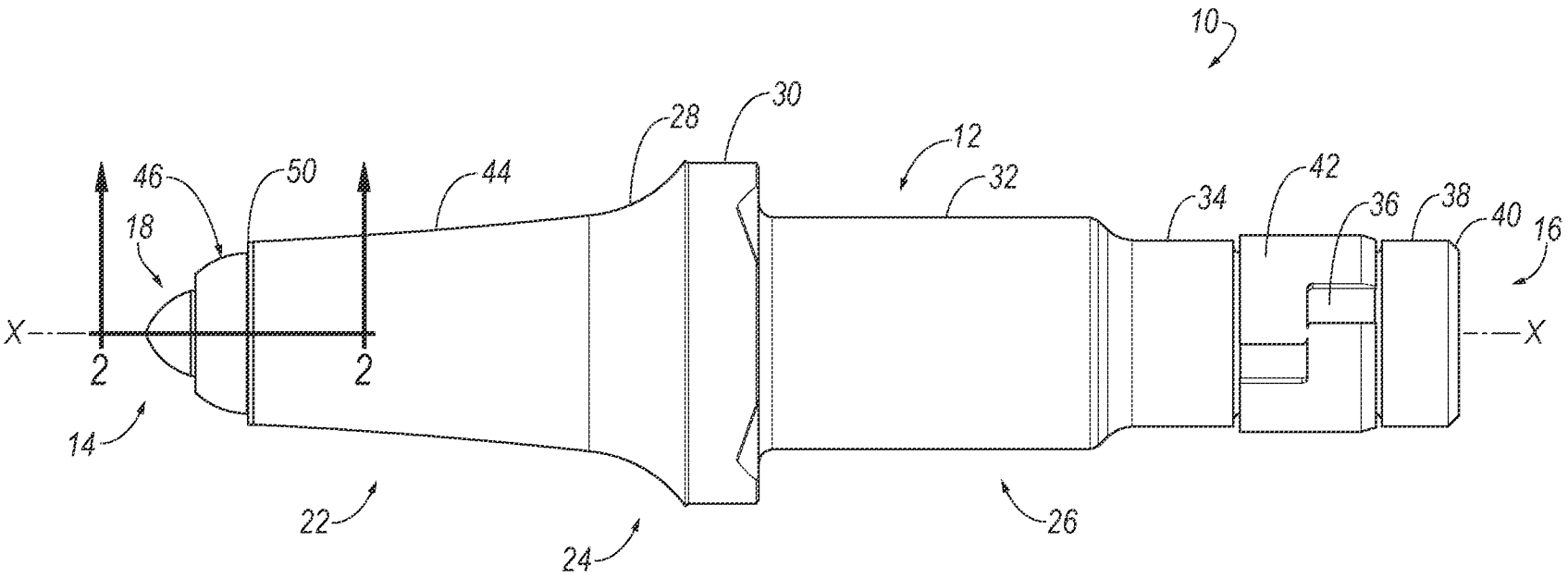
FIG. 1 is a side view of a rotary cutting tool with a cutting insert and a bolster according to an embodiment of the invention.

Referring to the drawings wherein like reference characters designate like elements, a rotatable cutting tool 10 is generally shown in FIG. 1 according to an aspect of the invention. The rotatable cutting tool 10 comprises an elongate cutting tool body, generally designated as 12. The cutting tool body 12 is typically made of steel, such as Mn—B steel alloy, and the like. The cutting tool body 12 has an axial forward end 14 and an axial rearward end 16. A hard tip or cutting insert 18 is affixed (such as by brazing or the like) into a socket 20 in the axial forward end 14 of the cutting tool body 12.

The cutting tool body 12 is divided into three principal portions: namely, a head portion 22, a collar portion 24 and a shank portion 26. The most axial forward portion is the head portion 22 that begins at the axial forward end 14 and extends along longitudinal axis X-X in the axial rearward direction. The mediate portion is the collar portion 24 that begins at the juncture with the head portion 22 and extends along the longitudinal axis X-X in the axial rearward direction. The collar portion 24 comprises a tapered neck section 28 followed by a cylindrical collar section 30.

The most axial rearward portion is the shank portion 26 that begins at the juncture with the collar portion 24 and extends along the longitudinal axis X-X in the axial rearward direction. The shank portion 26 comprises a forward cylindrical tail section 32, followed by a mid-section 34, followed by a retainer groove 36, followed by a rearward cylindrical tail section 38 and terminating in a beveled section 40. As is known by those skilled in the art, the shank portion 26 is the portion of the cutting tool body 22 that carries a retainer 42. The retainer 42 rotatably retains the rotatable cutting tool 10 in the bore of a tool holder (not shown) or the bore of the sleeve carried by a holder.

Figure 2:
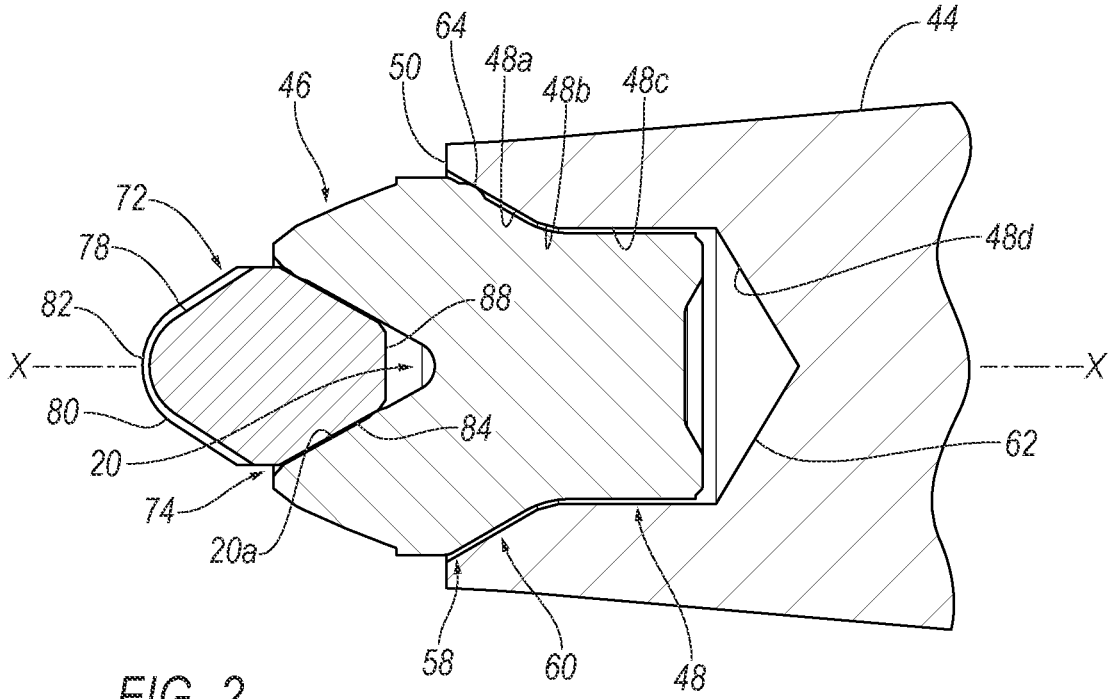
FIG. 2 is a cross-sectional view of the cutting insert, bolster and head portion of the rotary cutting tool taken along line 2-2 of FIG. 1.
Figure 3:
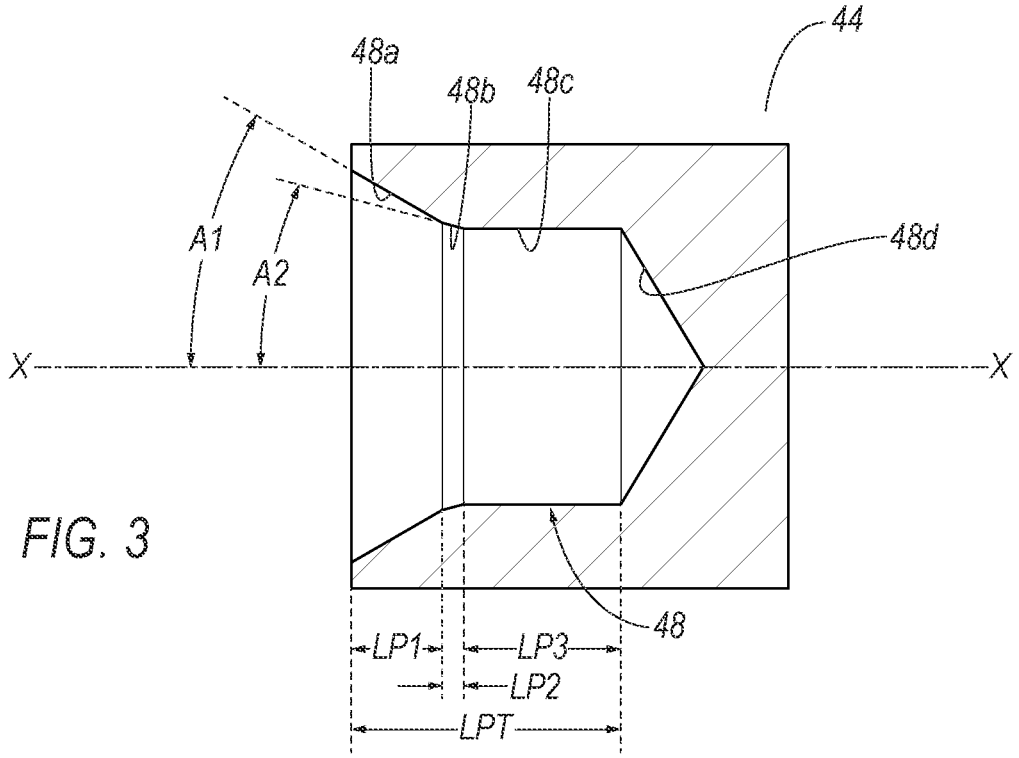
FIG. 3 is a cross-sectional view of the pocket of the base portion with the bolster and cutting insert removed for clarity.

Referring now to FIGS. 1-3, the head portion 22 includes a base portion 44 that is affixed to the collar portion 24. As illustrated in FIGS. 2 and 3, the base portion 44 of the head portion 22 is formed with a pocket, shown generally at 48. In one aspect, the pocket 48 extends axially along axis X-X from an axial forward end 50 of the base portion 44 rearwardly toward the collar portion 24. The pocket 48 is formed with a rearwardly tapering frustoconical side wall 48*a* extending rearward (i.e., in an axially rearward direction) from the axial forward end 50, a transition side wall 48*b* extending rearwardly from the first rearwardly tapering frustoconical side wall 48*a*, a cylindrical side wall 48*c* extending rearward from the transition side wall 48*b*, and a conical side wall 48*d* extending rearward from the cylindrical side wall 48*c*.

Referring to FIG. 3, the rearwardly tapering frustoconical side wall 48*a* is formed at an angle, A1, of between about twenty (20) and about forty (40) degrees with respect to the axis X-X. For example, in one embodiment, the angle, A1, is about thirty (30) degrees with respect to the axis X-X. The transition side wall 48*b* is formed at an angle, A2, less in magnitude than the angle, A1. For example, the angle, A2, can be between about ten (10) degrees and about twenty (20) degrees with respect to the axis X-X. It should be noted that the cylindrical side wall 48*c* extends substantially parallel to the axis X-X (i.e., at an angle of zero (0) degrees with respect to the axis X-X).

The rearwardly tapering frustoconical side wall 48*a*, the second transition side wall 48*b* and the cylindrical side wall 48*c* has a total length, LPT, along the axis X-X. The rearwardly tapering frustoconical side wall 48*a* has a length, LP1, along the axis X-X between about 25-50 percent of the total length, LPT. For example, the length, LP1, can be about thirty-three (33) percent of the length, LPT. The transition side wall 48*b* has a length, LP2, along the axis X-X. The cylindrical side wall 48*c* has a length, LP3, along the axis X-X between about 50-80 percent of the total length, LPT. For example, the cylindrical side wall 48*c* has a length, LP3, of about sixty-five (65) percent of the total length, LPT. It should be noted that the length, LP3, of the cylindrical side wall 48*c* is always larger in magnitude than the length, LP1, of the rearwardly tapering frustoconical side wall section 48*a*. It should be noted that the length, LP2, of the transition side wall 48*b* will always be less in magnitude than the length, LP1 of the rearwardly tapering frustoconical side wall section 48*a* and the length, LP3, of the cylindrical side wall 48*c*.

A bolster 46 is at least partially received in the pocket 48 of the base portion 44. The bolster 46 is made of a suitable material, such as cemented metal carbide material comprising about 1 to 40 percent concentration of cobalt by weight, preferably 5 to 10 percent. In one aspect, the cutting insert 18 is affixed to the bolster 46.

Referring now to FIGS. 4-7, the bolster 46 is shown according to one aspect of the invention. The bolster 46 has an axial forward end 52 and an axial rearward end 54. The bolster 46 is divided into three principal portions; namely, a head portion 56, a collar portion 58 and a shank portion 60 that terminates in a beveled section 62. The most axial forward portion is the head portion 56 that begins at the axial forward end 52 and extends along longitudinal axis Y-Y in the axial rearward direction. The head portion 56 is formed with a large radius, R1, of between about 1.5 in (38.1 mm) to about 3.5 in (88.9 mm). In one embodiment, for example, the radius, R1, is about 2.54 in (69.8 mm). The mediate portion is the collar portion 58 that begins at the juncture with the head portion 56 and extends along the longitudinal axis Y-Y in the axial rearward direction to the shank portion 60.

The shank portion 60 of the bolster 46 includes a rearwardly tapering frustoconical section 60*a*, a variably tapered section 60*b* extending in a rearward direction from the rearwardly tapering frustoconical section 60*a*, and a cylindrical section 60*c* extending the rearward direction from the variably tapered section 60*b* to the beveled section 62. The variably tapered section 60*b* provides a transition between the tapering frustoconical section 60*a* and the cylindrical section 60*c*.

In one aspect, the rearwardly tapering frustoconical section 60*a* of the shank portion 60 is formed with an angle, A3, with respect to the longitudinal axis Y-Y. In one embodiment, the angle, A3, of the first rearwardly tapering frustoconical section 60*a* is approximately equal to the angle, A1, of the rearwardly tapering frustoconical side wall 48*a* of the pocket 48. For example, the angle, A3, can be about thirty (30) degrees with respect to the longitudinal axis Y-Y.

In the illustrated embodiment, for example, the bolster 46 has a total length, LBT, of about 1.224 in (31.90 mm). The head portion 56 has a length, LB1, along the longitudinal axis Y-Y of about 0.35 in (8.89 mm), which is about twenty-seven (27) percent of the total length, LBT. The collar portion 58 has a length, LB2, along the longitudinal axis Y-Y of about 0.15 in (3.8 mm), which is about twelve (12) percent of the total length, LBT. The shank portion 60 has a length, LB3, of about 0.724 in (18.39 mm) along the longitudinal axis, Y-Y, which is about fifty-eight (58) percent of the total length, LBT. Thus, the length, LB3, of the shank portion 60 is at least fifty (50) percent of the total length, LBT, of the bolster 46. It will be appreciated that the lengths, LB1, LB2, LB3 and LBT are for illustrative purposes only and the invention can be practiced with any desirable lengths, LB1, LB2, LB3 and LBT, so long as the length, LB3 is at least fifty (50) percent of the total length, LBT, of the bolster 46.

Figure 7:
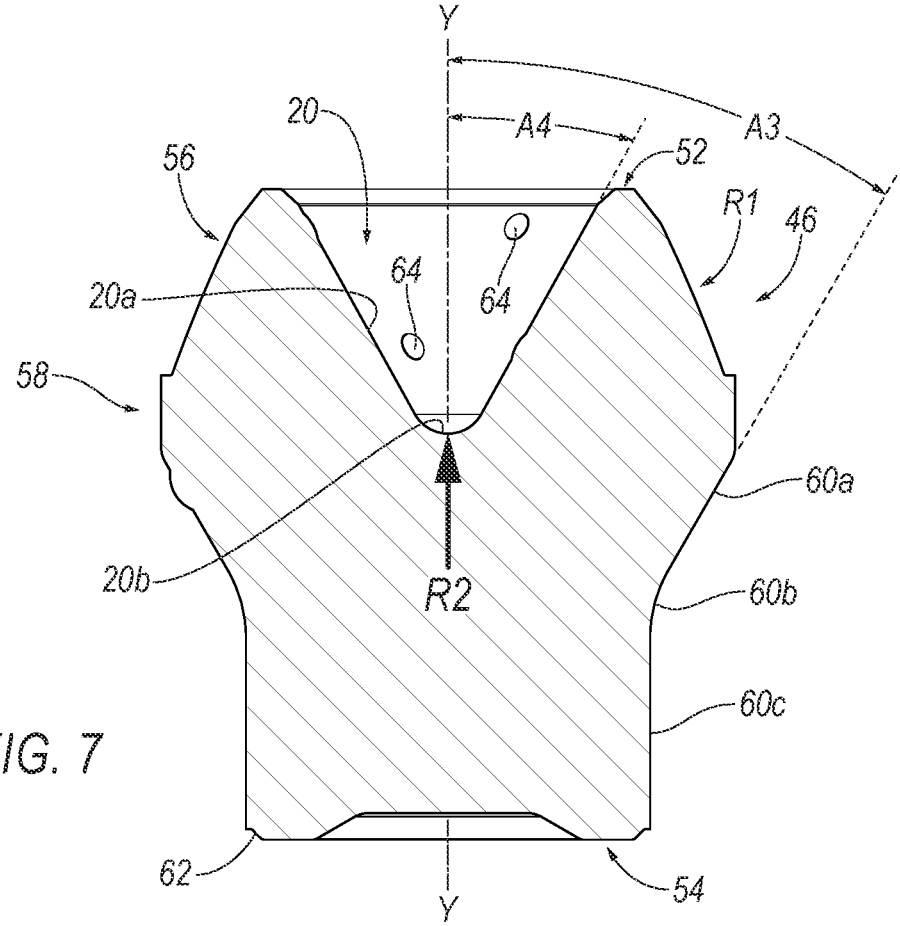
FIG. 7 is a cross-sectional view of the bolster taken along line 7-7 of FIG. 6.

As shown in FIG. 7, the head portion 56 of the bolster 46 includes the socket 20 for receiving the cutting insert 18. The socket 20 is formed with a rearwardly tapering conical side wall 20*a* terminating at a radius blend 20*b*. In one embodiment, conical side wall 20*a* is formed at an angle, A4, of between about twenty (20) degrees and about forty (40) degrees with respect to the longitudinal axis, Y-Y. In one embodiment, the radius blend 20*b* is formed with a radius, R2, in the range between about 0.060 in (1.52 mm) to about 0.080 in (2.03 mm).

Figure 5:
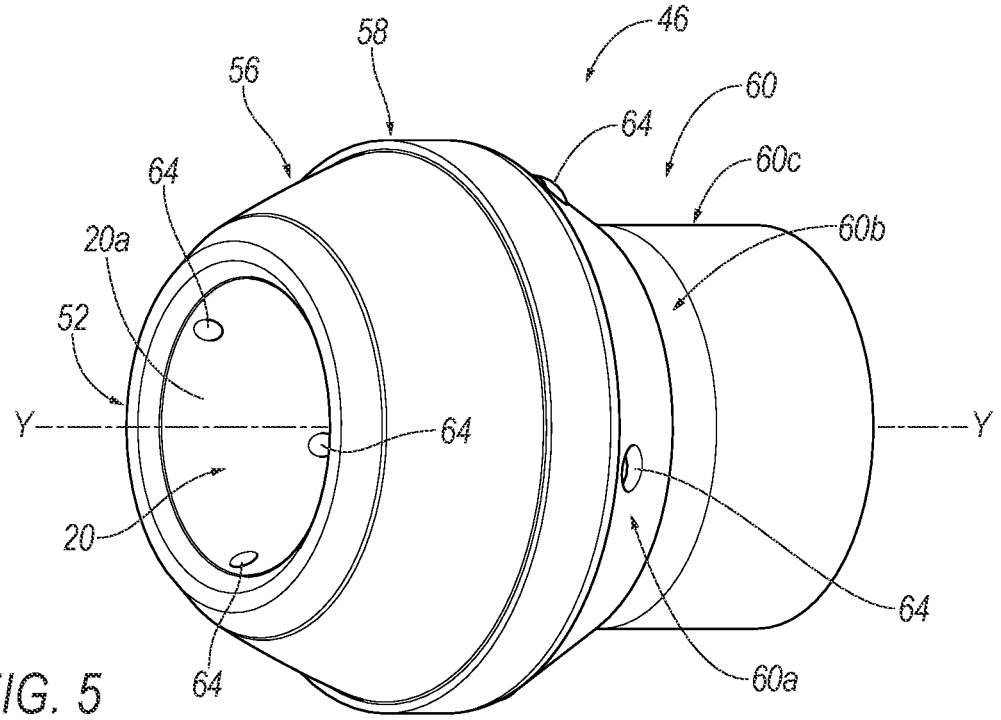
FIG. 5 is a side view of the bolster of FIG. 4.
Figure 4:
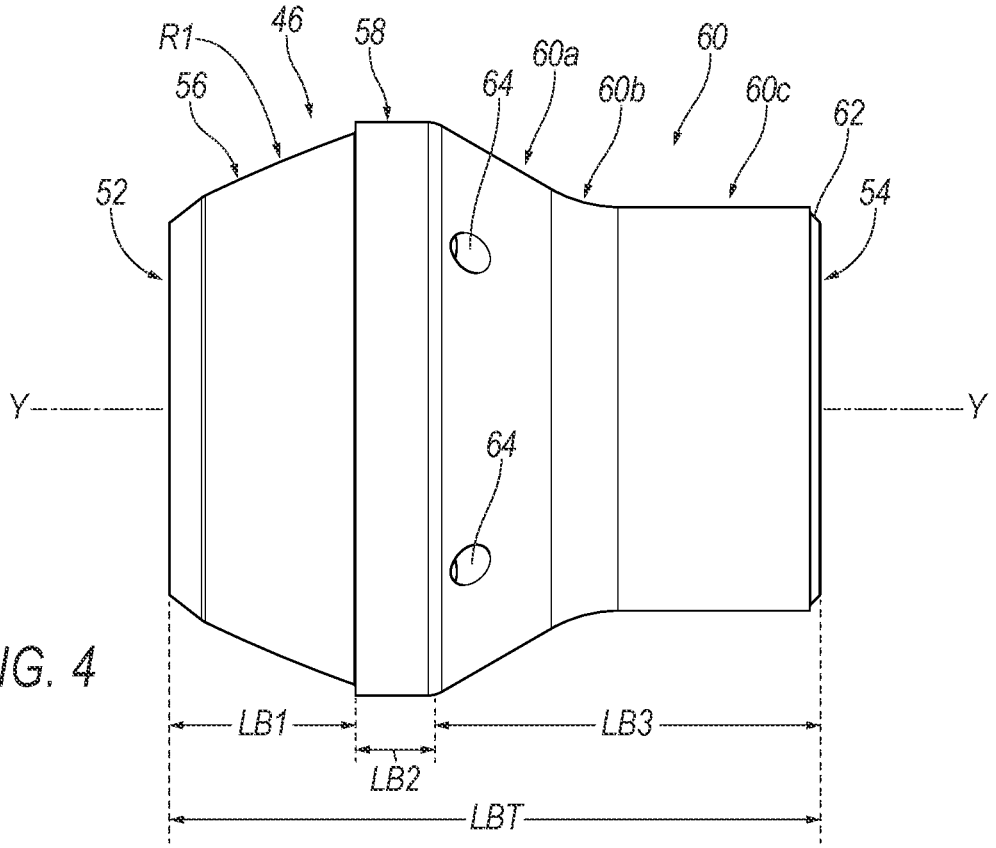
FIG. 4 is an isometric view of the bolster according to an embodiment of the invention.

As shown in FIGS. 4-7, the bolster 46 is movably connected to the base portion 44 when initially installed within the pocket 48 of the head portion 22. This movable connection is provided by a plurality of dimples 64 formed on the shank portion 60 that engage the pocket 48 of the base portion 44 of the head portion 22. Specifically, the dimples 64 are formed on the axially forward axially forward frustoconical section 60*a* of the shank portion 60 of the bolster 46. As shown in FIG. 5, the dimples 64 are equally spaced about the axially forward frustoconical section 60*a* of the shank portion 60. In the illustrated embodiment, the axially forward frustoconical section 60*a* has a total of five (5) dimples 64 equally spaced apart from each other by about seventy-two (72) degrees. However, it will be appreciated that the invention is not limited by the number of dimples 64, and that the invention can be practiced with any desirable number of dimples 64, so long as the bolster 46 is suitably movably connected to the base portion 44.

After positioned at the desired position within the pocket 48, the bolster 46 is then fixedly attached to the pocket 48 by brazing, and the like. In one embodiment, the bolster 46 is affixed to the pocket 48 by brazing between each dimple 64 and the collar portion 58. It will be appreciated that other means for fixedly attaching the bolster 46 to the base portion 44 may be provided in accordance with the scope of the invention.

Figure 6:
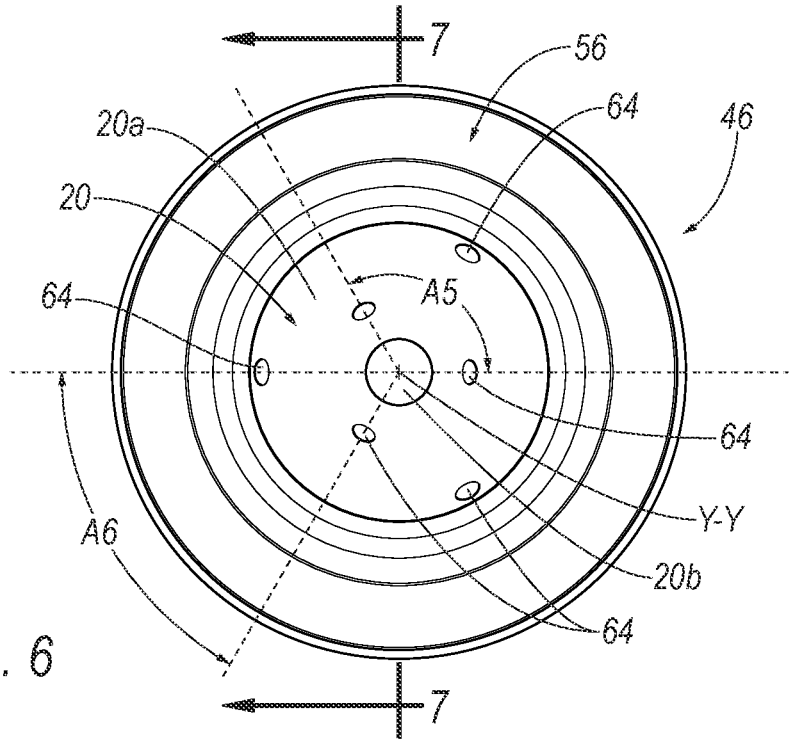
FIG. 6 is a top view of the bolster of FIG. 4.

Similar to the shank portion 60 of the bolster 48, the conical side wall 20*a* of the socket 20 also includes a plurality of dimples 64. As shown in FIG. 6, the dimples 64 lie in two circumferential rows about the conical side wall 20*a* of the socket 20, each row having three (3) equidistantly spaced dimples 64 at an angle, A5, of about one-hundred twenty (120) degrees such that the dimples 64 in one row is circumferentially spaced from the dimples 64 in the other row by an angle, A6, of about sixty (60) degrees.

Referring now to FIGS. 8-11, the hard tip or cutting insert 18 is shown according to an embodiment of the invention. The hard tip or cutting insert 18 has an axial forward end 68 and an axial rearward end 70. The cutting insert 18 is divided into three principal portions; namely, a conical head portion 72, a collar portion 74 and an axially rearward frustoconical portion 76 that terminates in a beveled section 77. The most axial forward portion is the head portion 72 that begins at the axial forward end 68 and extends along longitudinal axis Z-Z in the axial rearward direction. The mediate portion is the collar portion 74 that begins at the juncture with the head portion 72 and extends along the longitudinal axis Z-Z in the axial rearward direction to the axially rearward frustoconical portion 76. The collar portion 74 is divided into two sections: an axially forward first section 74*a* and an axially rearward second section 74*b*.

Figure 9:
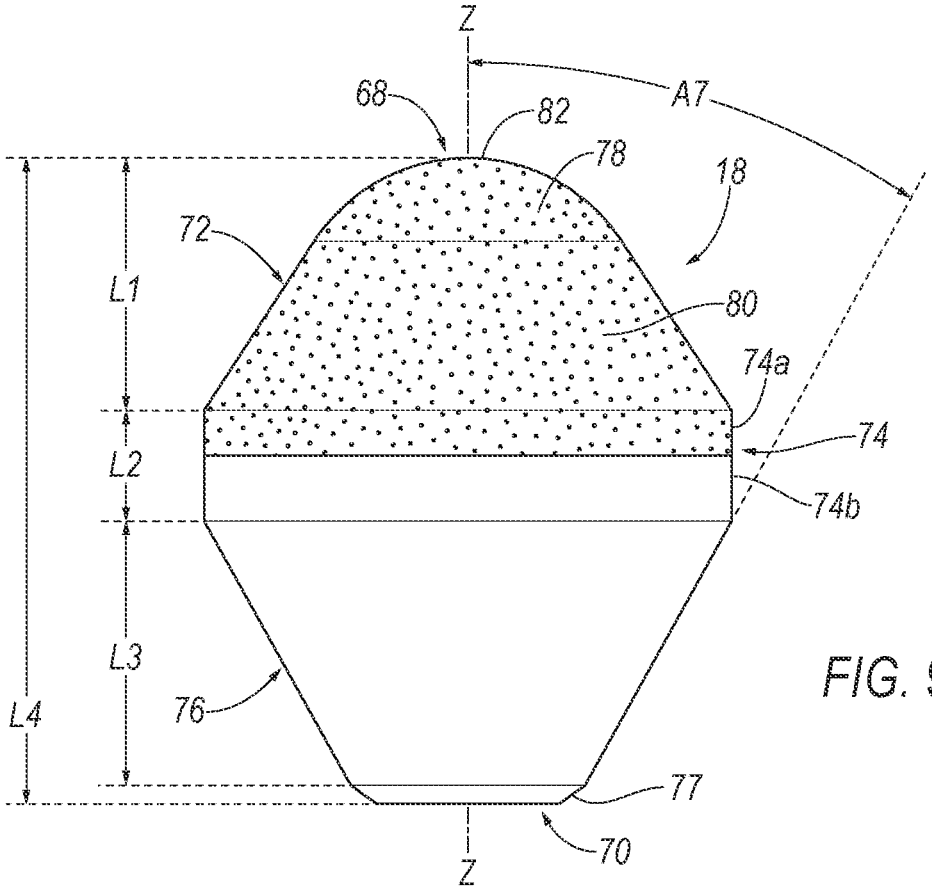
FIG. 9 is a side view of the cutting insert of FIG. 8.
Figure 10:
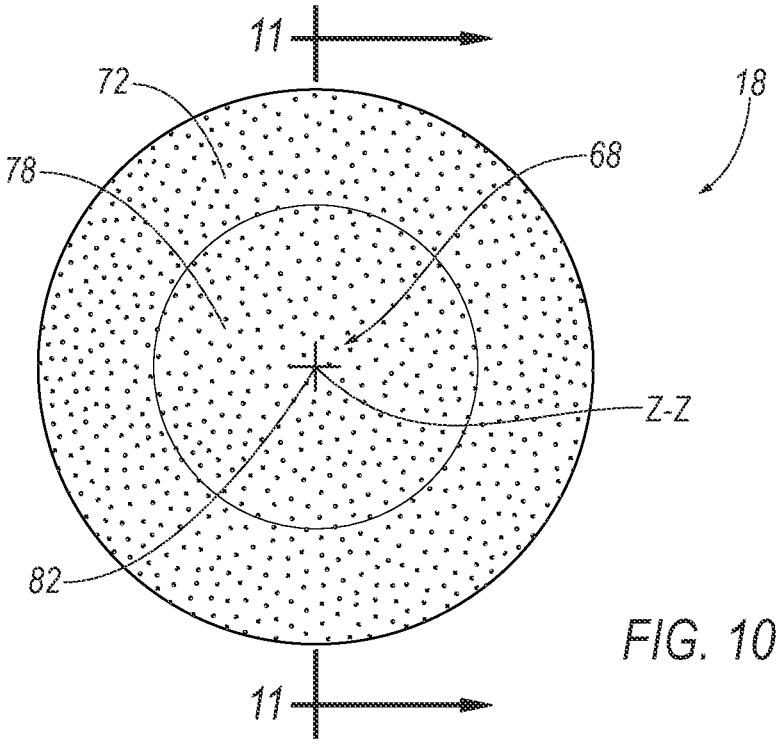
FIG. 10 is a top view of the cutting insert of FIG. 8.

As shown in FIG. 9, the axially rearward frustoconical portion 76 is formed at an angle, A7, with respect to the longitudinal axis Z-Z. In general, the angle, A7, is approximately equal to the angle, A4, of the socket 20. In one embodiment, the angle, A7, is in the range between about twenty (20) degrees and about forty (40) degrees. For example, the angle, A7, can be about twenty-nine (29) degrees. In the illustrated embodiment, the axially rearward end 70 is substantially planar. However, it will be appreciated that the invention is not limited by the rearward section 88 being planar, and that the invention can be practiced with any desirable geometry, such as tapered, non-planar, and the like, so long as the geometry of the cutting insert 18 can be properly seated within the socket 20 of the bolster 46.

Figure 8:
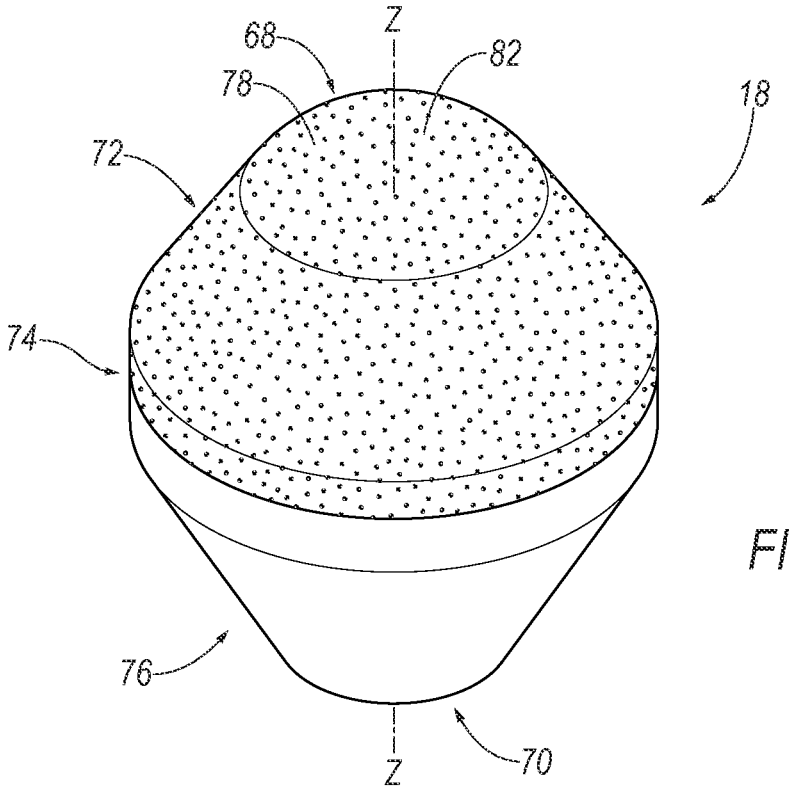
FIG. 8 is a top isometric view of the cutting insert according to an embodiment of the invention.
Figure 11:
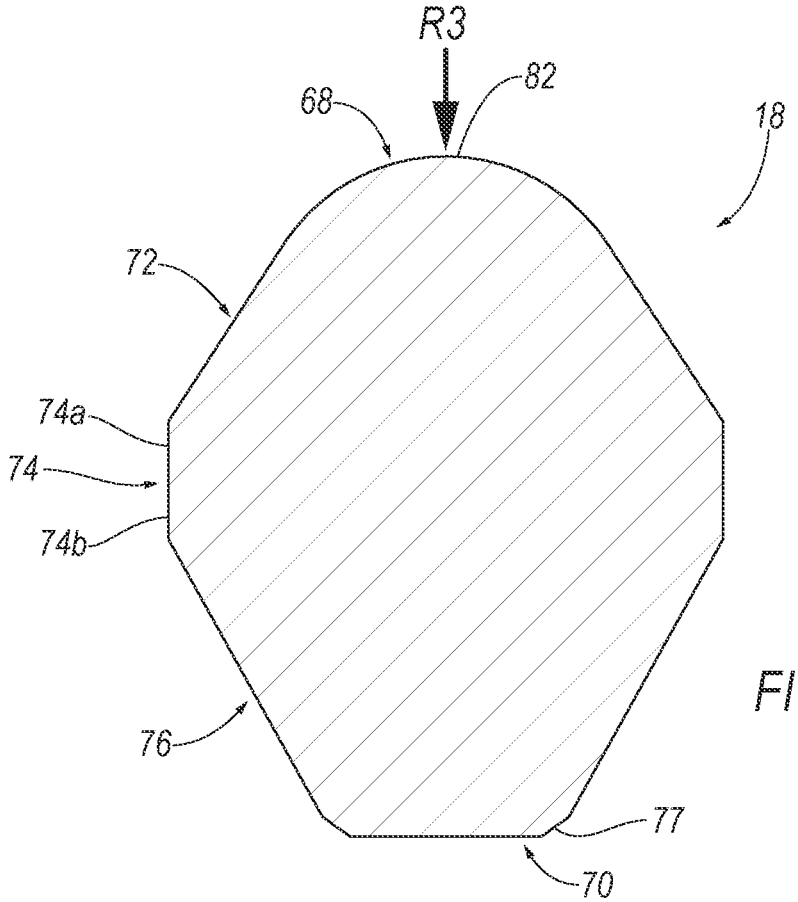
FIG. 11 is a cross-sectional view of the cutting insert taken along line 11-11 of FIG. 10.

As shown in FIG. 11, the cutting insert 18 comprises a super hard material 78 bonded to a cemented metal carbide substrate 80. The super hard material may be bonded to the substrate through a high temperature, high pressure process. The super hard material 78 may comprise a ceramic material, diamond, polycrystalline diamond (PCD), natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof. The super hard material 78 may have a thickness of at least 0.100 in (2.54 mm). As shown in FIGS. 8 and 9, the super hard material 78 is bonded only to the head portion 72 and the axially forward first section 74*a* of the collar portion 74 of the cutting insert 18.

In the illustrated embodiment, the head portion 72 of the cutting insert 18 has a substantially pointed geometry with an apex 82 having a radius, R3, of between about 0.050 in (1.27 mm) to about 0.125 in (3.175 mm). For example, the apex 82 may have a radius, R3, of about 0.090 in (2.40 mm).

As shown in FIG. 9, the axially forward frustoconical portion 72 can have a length, L1, of between about 0.25 in (6.35 mm) and about 0.35 in (8.89 mm). For example, the length, L1, can be about 0.27 in (8.27 mm). The collar portion 74 has a length, L2, of between about 0.07 in (1.8 mm) to about 0.15 in (3.81 mm). For example, the collar portion 74 can have a length of about 0.12 in (3.05 mm). The axially rearward frustoconical portion 76 can have a length, L3, of 0.304 in (7.72 mm). The cutting insert 18 can have a total overall length, L4, of between about 0.55 in (13.97 mm) and about 0.75 in (19.05 mm). For example, the total overall length, L4 of the cutting insert 18 can be about 0.694 in (17.63 mm). Thus, the length, L3, of the axially rearward frustoconical portion 76 can be between about forty percent (40%) and about fifty-five percent (55%) of the total length, L4, of the cutting insert 18.

As mentioned above, the cutting insert 18 is affixed to the socket 20 of the bolster 46 by brazing, and the like. Because the geometry of the cutting insert 18 generally conforms to the geometry of the socket 20 of the bolster 46, the cutting insert 18 is affixed to the side wall 20*a* of the socket 20. However, it will be appreciated that the geometry of the cutting insert 18 can vary depending upon the specific application, so long as the collar portion 74 and the axially rearward frustoconical portion 76 conforms to the geometry of the socket 20 of the bolster 46.

As described above, the shank portion 60 of the bolster 46 provides a narrow bottom style geometry and the axially rearward frustoconical portion 76 of the cutting insert 18 provides a tapered geometry that increases the strength of the braze joint between the bolster 46 and the base portion 44 to reduce forces and stresses transmitted to the cutting tool (10) during a machining operation, thereby avoid failures during the machining operation.

The patents and publications referred to herein are hereby incorporated by reference.

Having described presently preferred embodiments the invention may be otherwise embodied within the scope of the appended claims.

What is claimed is:

1. A rotatable cutting tool, comprising:

a cutting tool body, the cutting tool body having an axial forward end, an axial rearward end, a head portion axially rearward of the axial forward end, a collar portion axially rearward of the head portion, and a shank portion axially rearward of the collar portion and axially forward of the axial rearward end, the head portion including a base portion formed with a pocket, the pocket is formed with a rearwardly tapering frustoconical side wall extending rearward from the axial forward end, a transition side wall extending rearwardly from the first rearwardly tapering frustoconical side wall, and a cylindrical side wall extending rearward from the transition side wall;

a bolster at least partially received in the pocket, the bolster including a head portion, a collar portion and a shank portion, the head portion including a socket formed with a rearwardly tapering conical side wall and a radius blend formed with a radius, R2, the shank portion includes a rearwardly tapering frustoconical section, a variably tapered section extending in a rearward direction from the rearwardly tapering frustoconical section, and a cylindrical section extending in the rearward direction from the variably tapered section; and a cutting insert at least partially received in the socket of the bolster, the cutting insert comprising a super hard material bonded to a substrate and including a conical head portion, a collar portion and an axially rearward frustoconical portion, wherein the rearwardly tapering frustoconical side wall, the transition side wall and the cylindrical side wall of the pocket formed in the base portion of the cutting tool body has a total length, LPT, and wherein the cylindrical side wall of the pocket formed in the base portion of the cutting tool body extends substantially parallel to a longitudinal axis, X-X, of the pocket and has a length, LP3, along the longitudinal axis, X-X, of between about fifty percent and about eighty percent of the total length, LPT, to increase the strength of a braze joint between the bolster and the base portion of the cutting tool body, thereby reducing forces and stresses transmitted to the cutting tool during a machining operation.

2. The rotatable cutting tool according to claim 1, wherein the super hard material comprises a ceramic material, diamond, polycrystalline diamond (PCD), natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof.

3. The rotatable cutting tool according to claim 1, wherein the collar portion of the cutting insert includes an axially forward first section and an axially rearward second section.

4. The rotatable cutting tool according to claim 3, wherein the super hard material is bonded only to the conical head portion and the axially forward first section of the collar portion of the cutting insert.

5. The rotatable cutting tool according to claim 1, wherein the head portion of the cutting insert has a substantially pointed geometry with an apex having a radius, R3.

6. The rotatable cutting tool according to claim 1, wherein the head portion of the cutting insert has a length, L1, the collar portion of the cutting insert has a length, L2, and the axially rearward frustoconical portion of the cutting insert has a length, L3.

7. The rotatable cutting tool according to claim 6, wherein the length, L3, of the axially rearward frustoconical portion of the cutting insert is between about forty percent and about fifty-five percent of a total length, L4, of the head portion of the cutting insert.

8. The rotatable cutting tool according to claim 1, wherein the pocket is formed with a rearwardly tapering frustoconical side wall extending rearward from an axial forward end of the base portion, a transition side wall extending rearwardly from the rearwardly tapering frustoconical side wall, a cylindrical side wall extending rearward from the transition side wall, and a conical side wall section extending rearward from the cylindrical side wall section.

9. The rotatable cutting tool according to claim 8, wherein the rearwardly tapering frustoconical side wall of the pocket is formed at an angle, A1, of between about twenty degrees and about forty degrees with respect to a longitudinal axis, X-X, of the pocket, and wherein the transition side wall of the pocket is formed at an angle, A2, which is less than the angle, A1, of the rearwardly tapering frustoconical side wall of the pocket.

10. The rotatable cutting tool according to claim 1, wherein the rearwardly tapering frustoconical section of the shank portion of the bolster is formed with an angle, A3, of about thirty degrees with respect to a longitudinal axis, Y-Y, of the bolster.

11. The rotatable cutting tool according to claim 1, wherein the socket of the bolster is formed with a rearwardly tapering conical side wall terminating at a radius blend, and wherein the rearwardly tapering conical side wall is formed at an angle, A4, of between about twenty degrees and about forty degrees with respect to a longitudinal axis, Y-Y, of the bolster.

12. The rotatable cutting tool according to claim 11, wherein the socket of the bolster further includes a plurality of dimples formed in the rearwardly tapering conical side wall for engaging the cutting insert when the cutting insert at least partially received in the socket.

13. The rotatable cutting tool according to claim 12, wherein the plurality of dimples are arranged in two circumferential rows about the rearwardly tapering conical side wall of the socket.

14. The rotatable cutting tool according to claim 1, wherein the bolster further includes a plurality of dimples formed in the shank portion for engaging the pocket formed in the base portion of the head portion.

15. The rotatable cutting tool of claim 1, wherein the shank portion of the bolster has a length, LB3, along the longitudinal axis, Y-Y, which is at least fifty percent of a total length, LBT, of the bolster.

16. The rotatable cutting tool of claim 1, wherein the conical head portion of the cutting insert has a length, L1, the collar portion of the cutting insert has a length, L2, and the axially rearward frustoconical portion of the cutting insert has a length, L3, wherein the length, L3, of the axially rearward frustoconical portion is between about forty percent and about fifty-five percent of a total length, L4, of the head portion of the cutting insert.

17. The rotatable cutting tool according to claim 1, wherein the axially rearward frustoconical portion of cutting insert terminates at a beveled section.

18. The rotatable cutting tool according to claim 1, wherein the shank portion of the bolster terminates in a beveled section.

19. The rotatable cutting tool according to claim 1, wherein the rearwardly tapering conical side wall of the bolster is formed at an angle, A4, of between about twenty degrees and about forty degrees with respect to a longitudinal axis, Y-Y, and having a length, LB3, along the longitudinal axis, Y-Y, of at least fifty percent of a total length, LBT, of the bolster.

20. The rotatable cutting tool according to claim 1, wherein the axially rearward frustoconical portion of the cutting insert is formed at an angle, A7, of between about twenty degrees and about forty degrees with respect to a longitudinal axis, Z-Z, of the cutting insert and having a length, L3, along the longitudinal axis, Z-Z, of between about forty percent and about fifty-five percent of a total length, L4, of the cutting insert.

* * * * *